United States Patent [19]

Hieber

[11] 4,414,274

[45] Nov. 8, 1983

[54] THIN FILM ELECTRICAL RESISTORS AND PROCESS OF PRODUCING THE SAME

[75] Inventor: Konrad Hieber, Munich, Fed. Rep. of Germany

[73] Assignee: Siemens Aktiengesellschaft, Berlin & Munich, Fed. Rep. of Germany

[21] Appl. No.: 388,180

[22] Filed: Jun. 14, 1982

Related U.S. Application Data

[63] Continuation-in-part of Ser. No. 107,829, Dec. 28, 1979, abandoned, which is a continuation-in-part of Ser. No. 909,036, May 24, 1978, abandoned.

[30] Foreign Application Priority Data

May 31, 1977 [DE] Fed. Rep. of Germany ..... 2724498

[51] Int. Cl.[3] ..... H01C 7/00

[52] U.S. Cl. ..... 428/336; 204/192 F; 427/124; 427/126.1; 427/101; 338/25; 338/28; 338/308; 338/309; 428/428; 428/432; 428/446; 428/701; 428/702; 252/518; 252/519

[58] Field of Search ..... 204/192 F; 428/428, 428/432, 446, 336, 701, 702; 252/519, 518; 338/25, 28, 308, 309; 427/124, 126.1, 101

[56] References Cited

U.S. PATENT DOCUMENTS

| | | | |
|---|---|---|---|
| 3,042,542 | 7/1962 | Anders | 428/428 |
| 3,477,935 | 11/1969 | Hall | 204/192 F |
| 3,506,556 | 4/1970 | Gillery | 204/192 F |
| 3,703,456 | 11/1972 | Cordes | 204/192 F |
| 3,738,926 | 6/1973 | Westwood | 204/192 F |
| 3,763,026 | 10/1973 | Cordes | 204/192 F |
| 3,996,551 | 12/1976 | Croson | 427/124 |
| 4,021,277 | 5/1977 | Shirm | 204/192 F |
| 4,048,039 | 9/1977 | Daxinger | 428/428 |
| 4,051,297 | 9/1977 | Veigel | 428/428 |

FOREIGN PATENT DOCUMENTS 1570841 7/1980 United Kingdom .

OTHER PUBLICATIONS

J. Foerster, "Reactive Sputtering of Resistance," *Radio Mentor Electronics,* vol. 42, 1976 pp. 342–346.

K. Hieber, et al., "Structural and Electrical Properties of $CrSi_2$ Thin Film Resistors," *Thin Solid Films,* vol. 36, 1976, pp. 357–360.

*Primary Examiner*—Ellis P. Robinson

*Attorney, Agent, or Firm*—Hill, Van Santen, Steadman & Simpson

[57] ABSTRACT

Thin film electrical resistors comprised of a substantially homogeneous amorphous chromium-silicon-oxygen alloy having an empirical formula of $Cr_xSi_yO_z$ wherein X is a number in the range of about 0.3 to 0.39, y is a number in the range of about 0.4 to 0.52 and x is a number in the range of about 0.1 to 0.30, with the proviso that some of x, y and z is equal to 1. Such resistors exhibit a relatively high ohmic resistance in the range of about 2,000 to 16,000 $\mu\Omega\cdot$cm.

3 Claims, 1 Drawing Figure

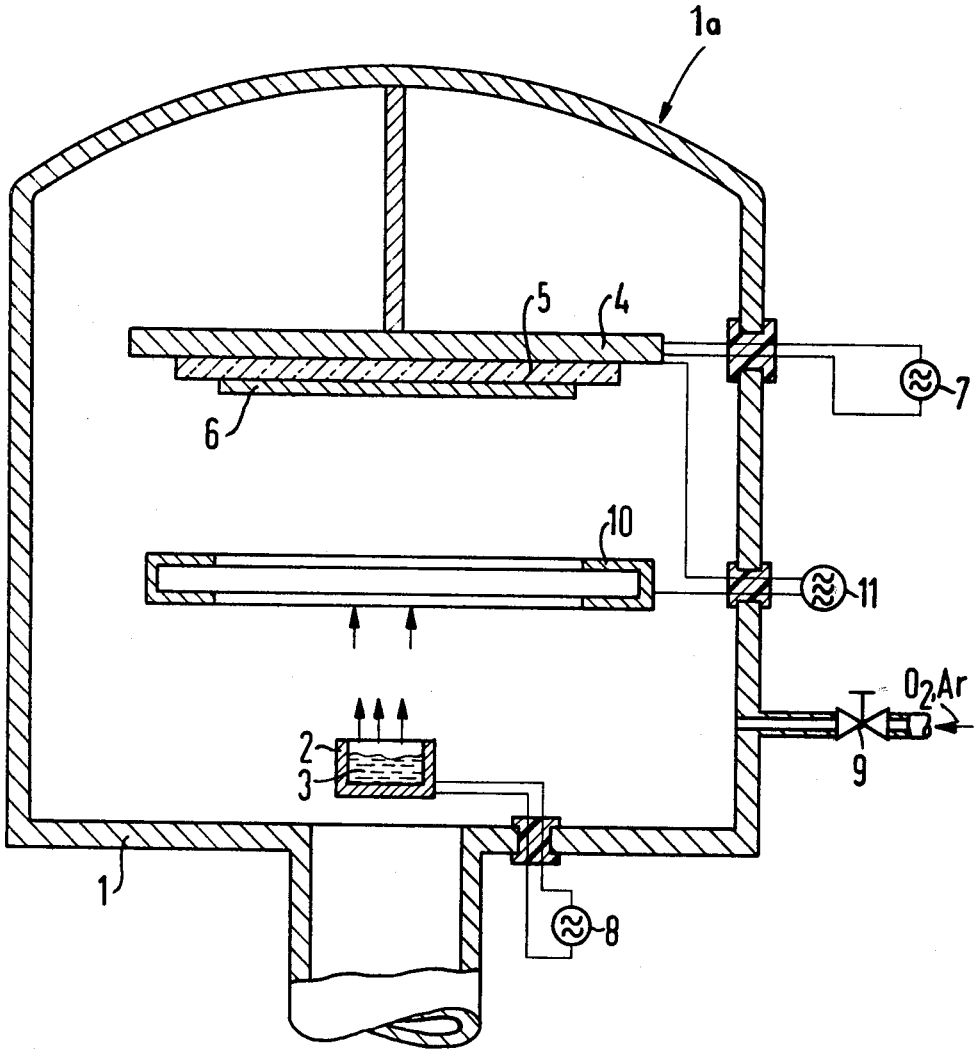
1a
5
4
7
6
10
11
$O_2$,Ar
2
3
9
1
8

THIN FILM ELECTRICAL RESISTORS AND PROCESS OF PRODUCING THE SAME

CROSS-REFERENCE TO RELATED APPLICATIONS

This is a continuation-in-part of co-pending application U.S. Ser. No. 107,829 filed Dec. 28, 1979 now abandoned, which in turn is a continuation-in-part of application U.S. Ser. No. 909,036 filed May 24, 1978 (now abandoned), all of which claim priority from German Patent Application No. P 27 24 498 0 filed May 31, 1977.

BACKGROUND OF THE INVENTION

1. Field of the Invention

The invention relates to electrical resistors and somewhat more particularly to thin film electrical resistors and a method of producing the same.

2. Prior Art

In electrical technology, low ohmic and high ohmic layer resistors are utilized in a variety of devices. For example, such layer resistors are required in discrete resistors, in RC-networks, in thin film wire strain gauges, as resistors in integrated semiconductor circuits, etc. Known materials for layer resistors of this type include nickel-chromium, tantalum nitride ($Ta_2N$) and tantalum oxynitride. These materials have a relatively low ohmic resistance, for example, a nickel-chromium layer or a tantalum nitride layer exhibits a surface resistance ranging between 50 to 300 Δ/□ and a temperature coefficient of electrical resistance in the range of about +50 to −300 ppm/°K. It is also known to use transition phase or mixtures of metals and metal oxides in forming layer resistors. It is further known to use chromium disilicide ($CrSi_2$) as a material for layer resistors (see J. Foerster, *Radio Mentor Electronic,* Vol, 42, 1972, pages 342–346; I. Nishida, *J. Material Science,* Vol. 7, 1972 page 1119 and K. Hieber et al, *Thin Solid Films,* Vol, 36, 1976 pages 357–360). The specific electrical resistance of a chromium disilicide layer of this type is about 1400 μΩ·cm and the temperature coefficient of electrical resistance thereof is in the range of about 500 to 800 ppm/°K.

Known high ohmic resistors are subjected to a high failure rate on account of greatly diminished reproducibility of relevant characteristics. Accordingly, there is a need for economical high ohmic resistors which have relevant characteristics that are readily reproducible in a relatively simple and reliable manner.

SUMMARY OF THE INVENTION

The invention provides a thin film electrical resistor which exhibits high ohmic resistance values that are readily reproducible in a relatively simple and reliable manner.

Generally, thin film electrical resistors produced in accordance with the principles of the invention comprise an electrically conductive layer composed of a substantially homogeneous amorphous chromium-silicon-oxygen alloy.

In preferred embodiments, the chromium-silicon-oxygen alloy of the invention has an empirical formula:

$$Cr_xSi_yO_z$$

wherein x is a value ranging from about 0.3 to 0.39, y is a value ranging from about 0.4 to 0.52, and z is a value ranging from about 0.1 to 0.30;

with the proviso that the sum of $x+y+z$ is equal to one. In preferred embodiments, the ratio of x to y is about 0.75 in the above empirical formulation.

In accordance with the principles of the invention, such thin film layer resistors are produced by generating a flux of Cr and Si atoms or particles, as by sputtering or vaporizing from a suitable source of such elements, in a controllable atmosphere having a select amount of $O_2$ therein and depositing such particles on a temperature-controlled substrate until a desired layer thickness is attained. In preferred embodiments, the temperature of the substrate is maintained between about 350° C. to 450° C. during the deposition of the alloy layer and the oxygen partial pressure within the deposition atmosphere is selectively maintained between about $10^{-1}$ N/m$^2$ ($10^{-3}$torr) to less than about $10^{-4}$ N/m$^2$ ($10^{-6}$torr).

The invention allows one to reliably attain a high ohmic resistance layer by insuring that the formed layer contains about 10 to 30 atomic percent oxygen therein, so that such layer is comprised of a substantial homogeneous amorphous mixture of chromium, silicon and oxygen atoms bound or agglomerated in some presently undeterminable manner within the layer so as to form a solid solution or alloy. Such high ohmic resistance layers possess a high degree of stability, a relatively low temperature coefficient of electrical resistance ranging between about 0 and −400 ppm/°K., with a specific electrical resistance ranging between about 2,000 and 16,000 μΩ·cm. Further, the high ohmic resistance layers of the invention exhibit, at a layer thickness of about 20 nm, a surface resistance ranging between about 1,000 and 8,000 Ω/□.

In accordance with the principles of the invention, a particularly desired resistance value can be obtained in a relatively simple manner by controlling the oxygen content of the ambient atmosphere present during the deposition of a layer resistor. Further, during the layer resistor deposition process, it is advantageous to maintain the substrate at a temperature ranging between about 350° C. and 450° C. This ensures that the deposited resistor layer is extremely stable and is not subject to aging effects.

Further, during the deposition process, the deposition rate is controlled so as to range between about 0.2 nm per second to 0.5 nm per second.

BRIEF DESCRIPTION OF THE DRAWING

The FIGURE is a somewhat schematic elevational cross-sectional view of an apparatus useful in producing thin film electrical resistors in accordance with the principles of the invention.

DESCRIPTION OF THE PREFERRED EMBODIMENTS

The invention provides high ohmic electrical resistors comprised of a layer of electrically conductive material which contains a substantially homogeneous amorphous mixture of chromium, silicon and oxygen atoms randomly distributed in a solid solution (alloy) on a substrate.

In accordance with the principles of the invention, the material of the layer resistor comprises a substantially homogeneous amorphous mixture of chromium, silicon and oxygen atoms bound or agglomerated in some presently undetermined manner within the layer so as to form a solid solution or alloy. This alloy has a general formula of:

$$Cr_xSi_yO_z$$

wherein x, y and z are numerals, the sum of which is equal to one and x ranges between about 0.3 to 0.39, y ranges between about 0.4 to 0.52 and z ranges between about 0.1 to 0.30. In preferred embodiments, the alloy material of the layer resistor contains a ratio of chromium to silicon atoms ranging between about 1 and 0.5 and more preferably between about 46/54 and 38/62 and most preferably is about 0.75. Layer resistors produced in accordance with the principles of the invention have a thickness ranging between about 8 nm and 50 nm.

The invention provides an electrical layer resistor comprised of a substrate and a layer of electrically conductive material positioned on a surface of such substrate. Such conductive material comprises a homogeneous amorphous chromium-silicon-oxygen alloy. This conductive material includes a sufficient amount of randomly distributed oxygen, which can be in the form of $Si/SiO_z$ or atomic oxygen, in combination with an amorphous mixture of chromium and silicon atoms so as to exhibit relatively high ohmic resistance in the range of about 2000 to 16,000 $\mu\Omega$·cm. Generally, the amount of oxygen present in such alloy (solid solution) ranges between about 10 to 30 atomic percent.

Production of layer resistors in accordance with the principles of the invention comprises generating a flux of Cr and Si atoms or the like, in an operational deposition atmosphere having a controlled $O_2$ partial pressure therein (i.e. containing oxygen at a selected partial pressure), as by subjecting a source of such elements to sputtering or vaporization conditions so as to produce vapors or particles thereof and depositing such particles onto a surface of a substrate until a desired layer thickness is achieved. In certain preferred embodiments of the invention, the deposition atmosphere contains a select amount of $O_2$ therein, preferable such atmosphere has an oxygen partial pressure ranging between about $10^{-1}$ N/m$^2$ ($10^{-3}$torr) to less than about $10^{-4}$ N/m$^2$ ($10^{-6}$torr). In preferred embodiments, the substrate is maintained at a temperature ranging between about 350° C. to 450° C. during the deposition process and the deposition rate is maintained at a rate ranging between about 0.2 nm per second and 0.5 nm per second.

Referring now to the FIGURE, an apparatus 1*a* useful in producing layer resistors of the invention is illustrated and comprises an evacuable housing 1 having a crucible 2 containing a Cr/Si source material 3 (such as elemental chromium and elemental silicon or a Cr/Si alloy or a mixture of such materials), useful for providing a flux of Cr and Si atoms. Mounted within the housing 1*a* is a substrate support means 4 which is operationally coupled to a controllable current source 7 so as to provide a select temperature to the substrate support means 4 and thus to the substrate 5. The substrate 5, for example composed of corning glass or aluminum oxide ($Al_2O_3$) is suitably mounted onto the support means 4. A layer resistor 6 is shown deposited on the free surface of the substrate 5.

The deposition of layer 6 may occur in various ways. For example, the source material 3 may be vaporized by heating the crucible 3. In such an embodiment, a controllable current source 8 is operationally coupled to the crucible 3. Alternatively, the deposition of layer 6 may occur via sputtering. In such an embodiment, the interior of the housing 1 is filled, via a controlled gas inlet 9 with a controlled admixture of an inert gas and oxygen. The inert gas may comprise argon at a partial pressure of about $2\cdot10^{-2}$ and the oxygen partial pressure is maintained at about $10^{-5}$ to $10^{-4}$ torr. A high-frequency antenna 10 operationally coupled to a high-frequency source 11 is provided within the housing 1 so as to produce an electrical discharge which triggers the sputtering process within the interior of housing 1 generating a flux of the desired particles. The voltage of the radio frequency current source 11 may, for example, be about 1,000 V, the oscillating frequency may, for example, be about 13.6 MHz and the RF power may, for example, be about 700 watts.

The starting or source material 3 can comprise a mixture of elemental chromium and elemental silicon wherein the chromium component has to be chosen in such a concentration that the ratio of chromium to silicon in the film is about 0.75.

In an exemplary embodiment for producing a high ohmic layer resistor of the invention, a source material was provided calculated to yield an amorphous chromium-silicon-oxygen alloy having the formula:

$$Cr_xSi_yO_z$$

wherein x ranged between 0.3 to 3.9, y ranged between about 0.4 to 0.52 and z ranged between 0.1 to 0.3, with the ratio of x to y being 0.75 and the sum of x, y and z being equal to one. The deposition atmosphere composed of an inert gas and oxygen, admitted into the interior of housing 1 via control valve 9, was provided at a partial pressure of about $10^{-5}$ to $10^{-4}$ torr and the apparatus energized for sputtering. The substrate support was, during the deposition process maintained at a temperature of about 350° C. to 450° C. The attained layer was comprised of a substantially homogeneous amorphous chromium-silicon-oxygen alloy. Because of the addition of $O_2$, no crystalline zones were present in the so-formed layer. This layer exhibited a specific resistance of 2000 $\mu\Omega$·cm to 4000 $\mu\Omega$·cm and had good stability.

Heating of the substrate (via the substrate support means) during a deposition process insures that all or substantially all excess Si atoms are transformed into oxides so that layer aging effects, the origin of which is oxidation of this type, can no longer occur.

In embodiments of the invention having particularly favorable stability characteristics and temperature coefficients of electrical resistance, it is preferred to utilize a starting or source material 3 which has a silicon concentration ranging between about 54 to 62 atom %.

As used herein and in the claim, the term "amorphous" is to be understood as denoting a random mixture of bound atoms in solid solution so that a layer formed therefrom does not contain any regions exhibiting long range ordering.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth and defined in the hereto-appended claims.

I claim as my invention:

1. An electrical layer resistor comprised of a substrate and layer of electrically conductive material positioned on a surface of said substrate, said conductive material comprising a substantially homogeneous amorphous chromium-silicon-oxygen alloy having an empirical formula:

$$Cr_xSi_yO_z$$

wherein x is a number in the range of 0.3 to 0.39, y is a number in the range of 0.4 to 0.52, and z is a number in the range of 0.1 to 0.30 with the proviso that the sum of x, y, and z is equal to one, said layer of conductive material having a thickness ranging between about 8 nm and 50 nm, said conductive material possessing a relative high degree of stability, a relatively low temperature coefficient of electrical resistance ranging between about 0 and −400 ppm/°K. and exhibiting a specific electrical resistance in the range of about 2000 to 16,000 μΩ·cm.

2. An electrical layer resistor as defined in claim 1 wherein said conductive material has a ratio of chromium to silicon such that the ratio of x to y in said empirical formula is equal to about 0.75.

3. A thin film electrical layer resistor comprised of a substrate and a layer of a conductive material positioned on a surface of said substrate, said conductive material comprising a substantially homogeneous amorphous alloy having an empirical formula of:

$$Cr_xSi_yO_z$$

wherein x is a number in the range of about 0.3 to 0.39, y is a number in the range of about 0.4 to 0.52, and z is a number in the range of about 0.1 to 0.30, with the sum of x+y+z being 1;

said layer of conductive material having a thickness ranging between about 8 nm and 50 nm, said conductive material possessing a relatively high degree of stability, a relatively low temperature coefficient of electrical resistance ranging between about 0 and −400 ppm/°K. and exhibiting a specific electrical resistance in the range of about 2,000 to 16,000·μΩcm; and said layer of conductive material being produced by:

providing a source material having a select amount of elemental Cr and elemental Si therein to satisfy the above empirical formula;

positioning a heat-controllable substrate within an enclosed operational material sputter deposition environment having a controlled oxygen partial pressure ranging from about $10^{-3}$ torr to about $10^{-4}$ torr and a controllable high-frequency electrical discharge therein;

generating a flux of Cr and Si atoms from such source while substantially simultaneously generating a flux of O atoms within said enclosed operational material deposition environment; and depositing Cr, Si and O atoms as a substantially homogeneous amorphous alloy onto said substrate until a desired layer of thickness is attained while maintaining said substrate at a temperature range of about 350° C. to 450° C. during deposition.

* * * * *